US005716249A

United States Patent [19]

Dyhrberg

[11] Patent Number: 5,716,249

[45] Date of Patent: Feb. 10, 1998

[54] MOORING MEANS

[75] Inventor: Roger Wayne Dyhrberg, Wandi, Australia

[73] Assignee: Advanced Mooring Technology, Pty Ltd., West Perth, Australia

[21] Appl. No.: 633,805

[22] PCT Filed: Oct. 18, 1994

[86] PCT No.: PCT/AU94/00634

§ 371 Date: Jun. 20, 1996

§ 102(e) Date: Jun. 20, 1996

[87] PCT Pub. No.: WO95/11158

PCT Pub. Date: Apr. 27, 1995

[30] Foreign Application Priority Data

Oct. 18, 1993 [AU] Australia ..... PM1871

[51] Int. Cl.[6] ..... B63B 22/02

[52] U.S. Cl. ..... 441/3; 114/230

[58] Field of Search ..... 441/1, 3–5, 6, 441/23; 114/293, 294, 230

[56] References Cited

U.S. PATENT DOCUMENTS 1,320,604 11/1919 Dame ..... 441/1

2,478,217 8/1949 Walters et al. ..... 114/230

3,077,614 2/1963 Lloyd ..... 441/3

4,280,436 7/1981 Jackson ..... 114/222

*Primary Examiner*—Edwin L. Swinehart

*Attorney, Agent, or Firm*—William A. Knoeller

[57] ABSTRACT

A mooring system comprises a sheave (12) adapted to be mounted to a base (11) which is located on the sea bed. In one embodiment, a cable (13) received in the sheave (12) is connected at one end to a first buoyant member (15) and is connected at its other end to a second buoyant member (23). The buoyancy of the second buoyant member (23) is less than that of the first buoyant member (15). Mooring energy caused by movement of a vessel moored to the second buoyant member is absorbed by the combination of a resistance to movement of the second buoyant member (23) as it is pulled away from a vertical position adjacent the cable (13) and the buoyancy of the first buoyant member (15) as it is pulled downwards by the cable (13) towards the sheave (12).

13 Claims, 5 Drawing Sheets

MOORING MEANS

This invention relates to moorings for water borne vessels.

Conventional moorings comprise a base which is fixed to the sea bed and a length of chain or the like is fixed at one end to the mooring while the free end of the chain is fixed to a mooring line supported from the surface of the water by a buoy for attachment to the mooring line of a vessel when required. On attachment of a vessel's mooring line to the cable, the base and chain serve to prevent movement of the vessel away from the mooring. The function of the chain is to provide an the inertial load created by the movement of the vessel away from the mooring as a result of water conditions and provide a reaction to the forces applied by the vessel in addition to the restraint by the base. As the load applied by the vessel increases so the chain will be lifted from the sea bed. When maximum load has been applied by the vessel, the chain is lifted free of the sea bed and the load of the chain is fully applied to the base. The arrangement as described above is also relevant to anchors which are conventionally provided with a length of chain which is attached to the end of the anchor rope whereby the chain serves to absorb at least some of the load applied by the vessel when in the moored condition and to absorb some of the inertial loads.

A difficulty with arrangements as described above relates to the amount of space that is required to be provided between moorings in order to provide for the free movement of a vessel under extreme conditions. Such moorings also create a difficulty in that as the vessel swings about the mooring, as a result of a change in wind, tidal or wave conditions, so the chain is dragged over the sea bed around the mooring. This erosion of the sea bed around the mooring base serves to destroy any sea grass, coral and other marine life that may be in the region over which the chain is dragged. This erosion also results in the continual disturbance of the sea bed, the effect of which disturbance is to introduce into the water, a suspension of sediments, nutrients and any pollutants that may be retained in the sea bed.

It is an object of this invention to provide a mooring system which is able to absorb the inertial loadings that may be applied to the mooring; which is able to accommodate the loadings that may be applied to the mooring as a result of movement of a moored vessel under extreme conditions; and which reduces the degree of disturbance of the sea bed in the region surrounding the mooring.

Throughout this specification the term "sea bed" shall be taken to include the bottom of any body of water in any aquatic environment.

SUMMARY OF THE INVENTION

According to the present invention there is provided a mooring system for mooring a floating vessel, the mooring system comprising:

a sheave assembly adapted to be anchored to a base located on the seabed;

a cable received in the sheave assembly;

a first buoyant member connected to a first length of the cable extending from one side of the sheave assembly and adapted to float on the surface of the water when the cable is in an unloaded condition;

a second buoyant member connected to a second length of the cable extending from the other side of the sheave assembly and having a buoyancy less than that of the first buoyant member, and wherein when the cable is in an unloaded condition the second buoyant member is adapted to lie substantially submerged below the surface of the water adjacent the first length of cable to maintain the first and second lengths of cable in a substantially vertical orientation and taut condition;

whereby, in use, when a mooring line of the vessel is connected to said second buoyant member, mooring energy caused by movement of the vessel and transferred to the mooring system can be absorbed by the combination of a resistance to movement of the second buoyant member as it is pulled away from a vertical position adjacent the first length of cable and the buoyancy of the first buoyant member as it is pulled downwards by the cable towards the sheave assembly.

According to a preferred feature the first buoyant member comprises a plurality of buoyant elements which are mounted sequentially on the cable. In addition it is preferred that the buoyancy of at least some of the buoyant elements increase with their spacing from the sheave.

In a preferred form the buoyant elements are supported on a rod element fixed to the other end of the cable. The length of the rod element may be greater than the combined length of the buoyant elements whereby the buoyant elements are slidable along the rod element and where the first buoyant element is limited in its extent of slidable movement along the rod element.

According to a further preferred feature, the second buoyant member may comprise a plurality of buoyant members supported along the cable. According to a further preferred feature, the buoyant members are spaced from each other and a weight is mounted to the cable intermediate each buoyant member.

BRIEF DESCRIPTION OF THE DRAWINGS

The invention will be more fully understood in the light of the following detailed description of preferred embodiments of the mooring system, given by way of example only. The description is made with reference to the accompanying drawings of which.

DETAILED DESCRIPTION OF PREFERRED EMBODIMENTS

Figure 1:
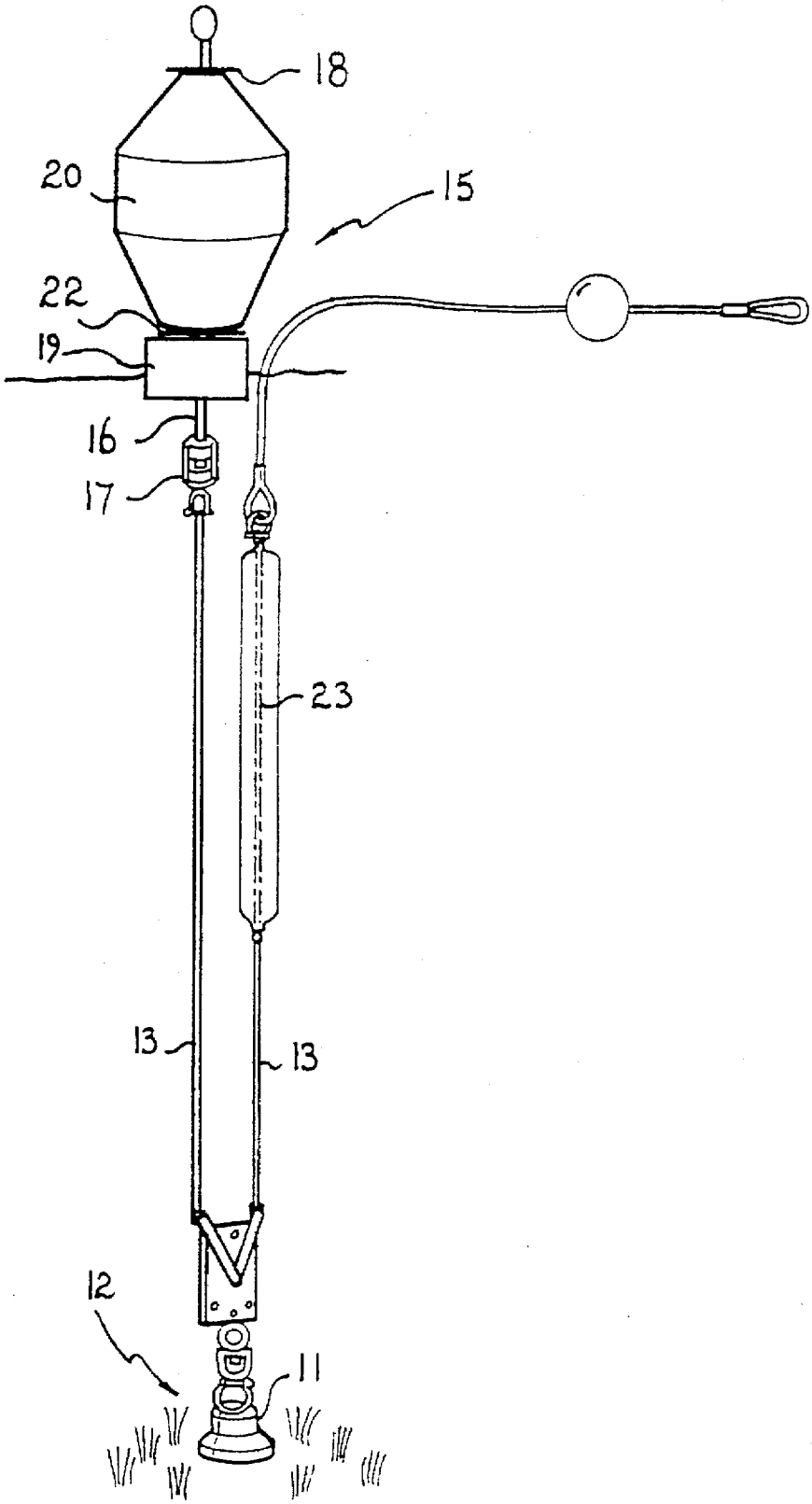
FIG. 1 is a schematic view in an unattached mode of the mooring means according to a first embodiment.
Figure 2:
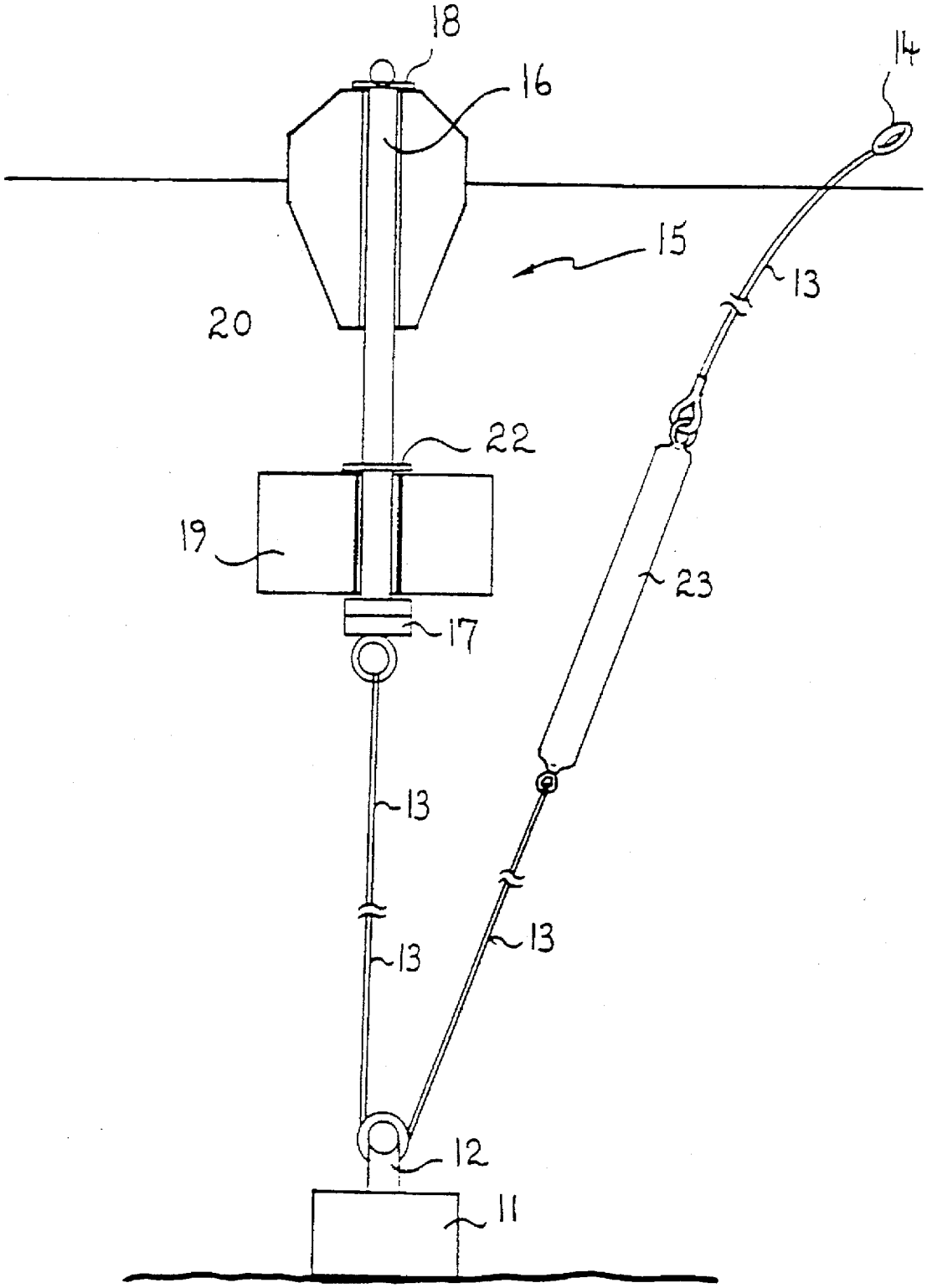
FIG. 2 is elevation of the first buoy when attached to moored vessel.

The mooring system according to a first embodiment is intended to be mounted to a base 11 which is located in the sea bed. The base may comprise any suitable means having sufficient mass and may comprise a conventional anchor with a length of anchor chain attached to it where the mooring system is mounted to the end of the chain remote from the anchor.

The mooring system according to this embodiment comprises a sheave 12 which is anchored to the base 11 and cable 13 which is received through the sheave. The sheave 12 is mounted to the base 11 through a pivot or swivel. One end of the cable is formed with an eye 14 to facilitate attachment of the mooring line of a vessel thereto. The other end of the cable 13 has a first buoy 15 fixed to it.

The first buoy 15 comprises an elongate rod 16 having an eye and associated swivel 17 mounted to its lower end which is fixed to the other end of the cable 13. The other end of the rod 16 is provided with a circular stop plate 18. The rod element 16 slidably supports a pair of buoyant elements 19 and 20 which are mounted in a series along the rod 16. The length of the rod 16 is greater than the combined length of the buoyant elements 19 and 20 and the buoyant elements are capable of slidable movement along the rod 16. A second stop plate 22 is mounted to the rod intermediate of the first and second buoyant elements 19 and 20 respectively and serves to limit the degree of slidable movement of the first buoyant element 19 along the rod 16. The first buoyant element 19 has a cylindrical configuration.

A second buoy 23 is mounted to the cable intermediate of the sheave 12 and the eye 14. The second buoy 23 is formed to have a rod-like configuration and incorporates a rod which extends through the buoy and is adapted at each end to be fixed into the cable 13. The second buoy 23 has a buoyancy less that the first buoy 15. As a result under no load conditions the second buoy will be submerged and lie closely adjacent the portion of the cable 13 between the sheave 12 and the first buoy 15.

In use when a mooring bridle of a vessel has been affixed to the eye 14 on the cable 13, the load which is initially applied to the cable 13 will be dissipated initially by the second buoy 23 and the first buoyant element 19. This dissipation will be effected by the second buoy being pulled away from the vertical position adjacent the cable 13 and thus being pulled under the water. In addition, the first buoyant element will also be pulled under the water to a limited extent. As the load which is applied by the mooring line increases the portion of the cable between the sheave 12 and the eye 14 will tend to straighten. As the load increases further the first buoy will be pulled downwardly towards the sheave 12 by the cable. The resultant submergence of the first buoyant element 19 will increase the counteracting force applied by the first buoy 15. Once the first buoyant element 19 has been fully submerged the degree of counteracting force applied by that buoyant element will remain constant and a further increase in the counteracting forces will applied by the first buoy will be as a result of the second buoyant element 20. The further counteractive force will only come into effect when the rod has been pulled downwardly to an extent such that the first stop plate 18 engages the upper surface of the second buoyant element 20 which will cause the second buoyant element to be pulled into the water.

The degree of buoyancy provided by the first buoy is sufficient to be able to accept an anticipated load desired of a particular mooring under the very worst conditions and as a result of such extreme conditions will the first buoy will become fully submerged. In the event of such an instance a suitable stop member may be provided along the cable 13 adjacent the junction with the rod element 16 to engage sheave and prevent any damage to the swivel and eye assembly which provides the attachment for the cable to the first buoy.

Under low tide conditions, the first buoy will float on the surface of the water and the second buoy 23 will be submerged and will be adjacent the cable 13 between the sheave 12 and the first buoy 15. Under high tide condition the first buoy 15 will cause the second buoy 23 to be pulled closer to the sheave 12.

The function of the embodiment as described above is to provide the same catenary through a mooring line as is conventionally applied by a conventional mooring line and chain, however, in so doing there is no contact between the mooring system and the sea bed. This results in no erosion of the sea bed and destruction of marine growth in the vicinity of the mooring as a result there is no introduction of sediments, nutrients and pollutants from the sea bed into the water by the action of mooring.

The number of buoyant elements which form the first buoy 15 may be varied in order to increase or decrease the degree of buoyancy. Furthermore, the buoyant elements may take any desired configuration including one which will provide a non-linear increase in the counteracting force being applied by the first buoy 15 against the load which is to be applied to the cable 13 by a moored vessel attached to the mooring.

Figure 5:
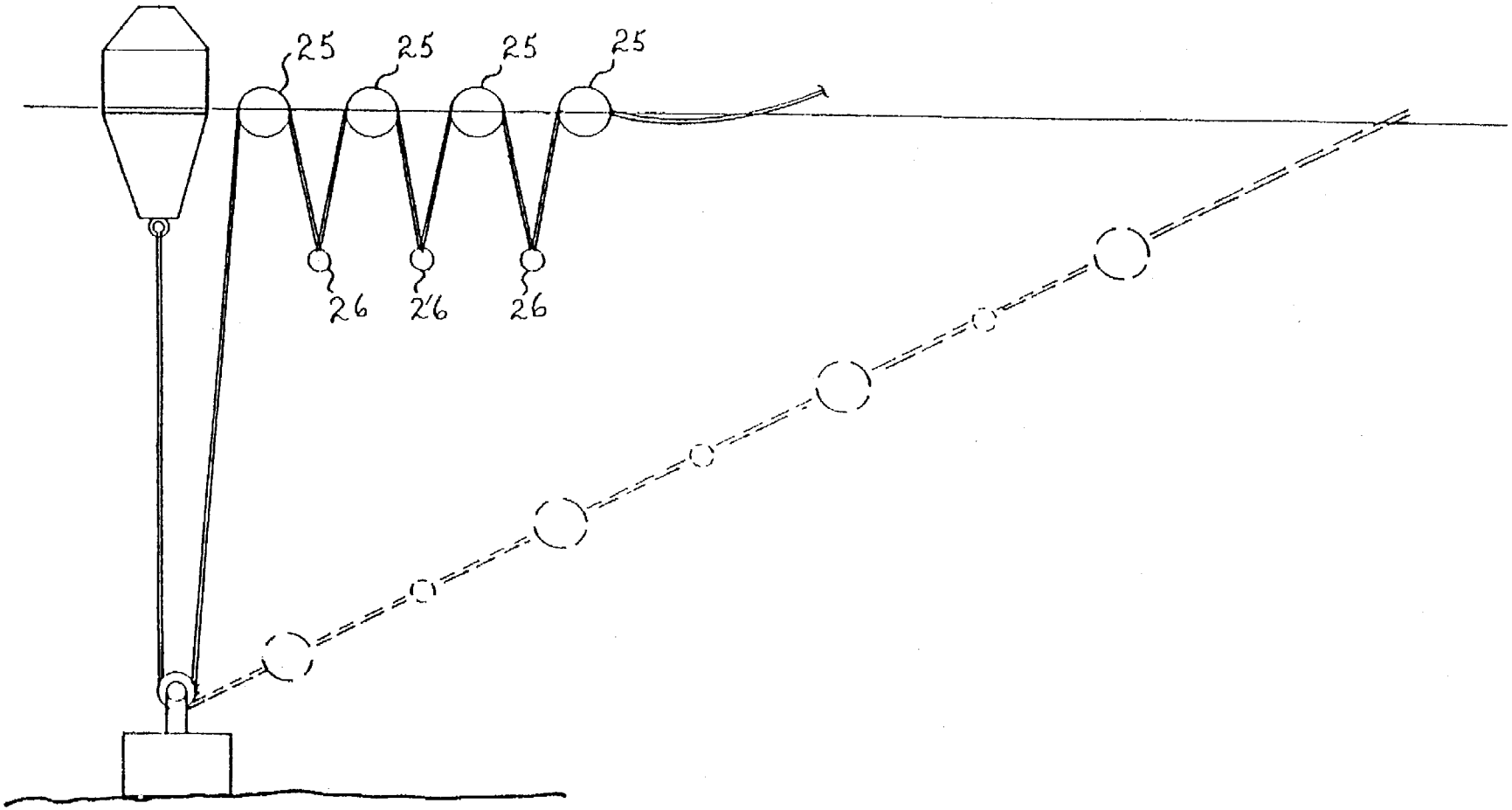
FIG. 5 is a schematic illustration of a fourth embodiment of the mooring system having an alternative form of the second buoy.

In an alternative arrangement the second buoy 23 may comprise a plurality of buoyant members mounted in series along the cable 13 and which are able to float on the surface. As a result, when a load is applied by the mooring line to the cable 13, each of these buoyant members will be consequently submerged to provide a graduated increase in the reaction force applied to the load being applied by the vessel. A variation of this form of second buoy is shown at FIG. 5 where the buoyant members 25 are located at spaced intervals along the cable 13 and where a weight 26 is mounted to the cable midway between each of the buoyant members 25. Under no load conditions, the biasing force applied by the weights 26 will cause the buoyant members to be pulled to close abutting relationship with each other. Any load which is applied to the cable 13 by a moored vessel will initially need to counteract the effort applied by the weights in order to cause separation of the second buoyant members 25 prior the second buoyant members being submerged.

Figure 3:
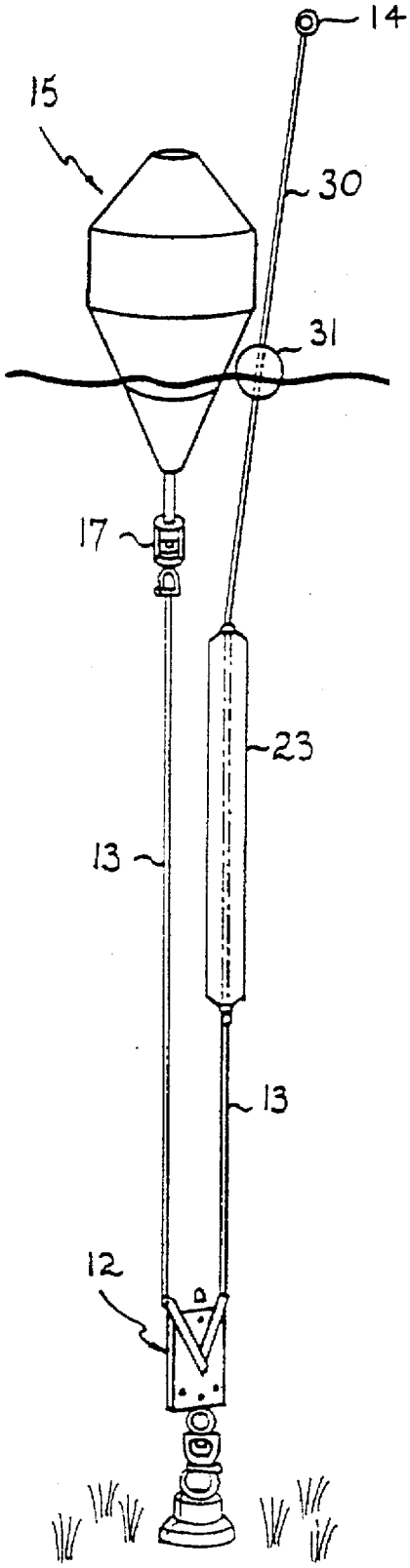
FIG. 3 is a schematic view of a second embodiment.

According to a second embodiment which is a variation of the first embodiment and which is shown at FIG. 3 the portion of the cable 13 between the second buoy 23 and the one end may be replaced by a rigid or semi rigid rod 30 having the eye 14 at its outer and a float 31 whereby the eye 14 is held above the surface of the water to facilitate the retrieval of the mooring.

Figure 4:
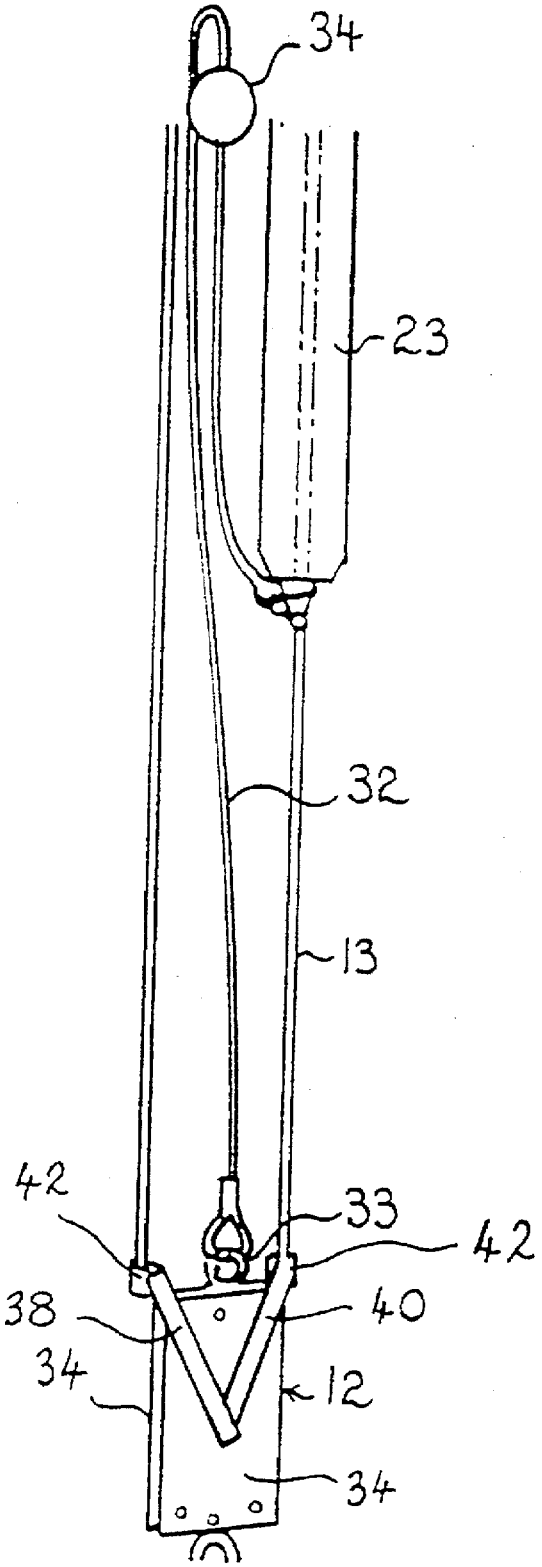
FIG. 4 is a part schematic view of a third embodiment showing the retaining line.

According to a third embodiment shown at FIG. 4, the mooring of the first and second embodiments are provided with a retaining line 32 fixed between an eye 33 provided on the sheave or if desired on tile base 11 and the lower end of the second buoy 23. The retaining line 32 has a length such that under the very worst conditions the retaining line will prevent the first buoy 15 from being fully submerged. The retaining line 32 is provided with a small float 34 of intermediate length which hold the retaining line clear of the sea bed and sheave when it is slack. The retaining line 32 also acts as a safety wire should the mooring cable 13 fail due to fatigue or wear.

In each of the embodiments, the cable 13 may be readily cleaned of marine growth by disconnecting the cable from one or other of the buoys and drawing the cable through the sheave assembly.

As can be seen most clearly in FIG. 4 the preferred embodiment of the sheave assembly comprises a grooved pulley or sheave 12 rotatably mounted between first and second plates 34. First and second arms 38, 40 are connected to the sheave assembly and are each provided with a block 42 at the free end thereof. The mooring cable 13 is threaded through a hole in the block 42 on the first arm 38, it then passes around the sheave and back up through a hole in the block 42 on the second arm 40.

Under adverse weather conditions additional buoyant elements can be applied to the first buoy in order to increase the capacity of the mooring.

In comparing the mooring system of the above described embodiments with a conventional mooring the following advantages are provided:

1. A counteracting tension is provided by the second buoy against the first buoy which serves to retain all of the pendant assembly of the mooring line above the sea bed floor. As a result no moving parts radiate around the mooring. This serves to minimise the damage to sea grass and disturbance of the sediment in the sea bed.
2. The first buoy serves to provide a continual reaction force against any load which is being imposed upon it. Only when the total buoyancy of the first buoy has been overcome and the line and the cable 13 has been fully drawn under will the moored vessel use its maximum swing.
3. As the inertial force and load created by a moored vessel diminishes, the reaction force provided by the second buoy will cause the second buoy to move towards a position adjacent the first buoy and thus recover the swinging room of the vessel to result in a centering effect.
4. The mooring system of the described embodiments is less massive than that of conventional moorings which use heavy chain.
5. The system also requires less joining and wear points than conventional assemblies.
6. The elongated shape and buoyancy of the second buoy act to prevent entanglement of the mooring cable.

It should be appreciated that the scope of the present invention should not be limited to the particular scope of the embodiments described above. In addition, it will be appreciated that any reference to sea bed or marine conditions will be taken to apply to any aquatic environment.

I claim:

1. A mooring system for mooring a floating vessel, the mooring system comprising:

a sheave assembly adapted to be anchored to a base located on a seabed;

a cable freely passing through the sheave assembly;

a first buoyant member connected to a first length of the cable extending from one side of the sheave assembly and adapted to float on a surface of water above said sheave assembly when the cable is in an unloaded condition;

a second buoyant member connected to a second length of the cable extending from the other side of the sheave assembly and having a buoyancy less than that of the first buoyant member, and wherein when the cable is in an unloaded condition the second buoyant member will lie substantially submerged below the surface of the water adjacent the first length of cable to maintain the first and second lengths of cable in a substantially vertical orientation and taut condition; and means for connecting a mooring line of the vessel to said second buoyant member, so that mooring energy caused by movement of the vessel and transferred to the mooring system is absorbed by the combination of a resistance to movement of the second buoyant member as it is pulled away from a vertical position adjacent the first length of cable and the buoyancy of the first buoyant member as it is pulled downwards by the cable and towards the sheave assembly.

2. A mooring system as claimed in claim 1, wherein the second buoyant member is elongate and is fixed at one end to the second length of cable.

3. A mooring system as claimed in claim 1, wherein the first buoyant member has a configuration whereby at least a portion increases in cross-sectional area between a lower and upper end.

4. A mooring system as claimed in claim 1, wherein the first buoyant member comprises a plurality of first buoyant elements mounted sequentially one above the other.

5. A mooring system as claimed at claim 4, wherein of any pair of adjacent first elements, the upper most first buoyant element has a greater volume that the lower adjacent first buoyant element.

6. A mooring system as claimed in claim 5, wherein the first buoyant elements are supported on a rod element connected to said first length of the cable.

7. A mooring system as claimed in claim 6, wherein the length of the rod element is greater than the combined length of the first buoyant elements and wherein the first buoyant elements are slidable along the rod element.

8. A mooring system as claimed in claim 7, wherein the degree of slidable movement of the lowermost first buoyant element is less than the degree of slidable movement of the other first buoyant elements.

9. A mooring system as claimed in claim 1, wherein said sheave assembly includes a sheave pulley rotatably mounted between first and second plates and said sheave assembly is pivotally mounted to the base through a swivel.

10. A mooring system as claimed in claim 1, wherein a rod-like element is connected to said second buoyant member and is supported by a float adapted to maintain one end of the rod-like element above the surface of the water for connection to a mooring line of the vessel.

11. A mooring system as claimed in claim 1, wherein a retaining line is fixed between the base and the second buoyant member, said retaining line having a length sufficient to prevent the first buoyant member from being pulled into engagement with the sheave.

12. A mooring means as claimed at claim 11, wherein the retaining line has a length sufficient to prevent the first buoyant member from being fully submerged.

13. A mooring system as claimed in claim 1, wherein the means for connecting a mooring line of the vessel is located between the second buoyant member and the vessel.

* * * * *